United States Patent [19]

Zellman

[11] Patent Number: 4,739,584

[45] Date of Patent: Apr. 26, 1988

[54] GARAGE DOOR LOCKING MECHANISM

[76] Inventor: Peter Zellman, 16138 Medlar La., Chino Hills, Calif. 91709

[21] Appl. No.: 922,356

[22] Filed: Oct. 23, 1986

[51] Int. Cl.[4] ..... E05F 11/00

[52] U.S. Cl. ..... 49/199; 49/301; 49/449

[58] Field of Search ..... 49/199, 289, 449, 301, 49/197; 292/DIG. 3, 171, 38; 254/9, 131

[56] References Cited

U.S. PATENT DOCUMENTS 3,788,073 1/1974 Castela ..... 175/5

4,442,631 4/1984 Weber ..... 49/199

4,597,224 7/1986 Tucker ..... 49/199

*Primary Examiner*—Kenneth J. Dorner

*Assistant Examiner*—Gerald A. Anderson

*Attorney, Agent, or Firm*—G. Donald Weber, Jr.

[57] ABSTRACT

An auxiliary or backup locking mechanism which is used primarily with garage doors of the swing-up type which are controlled by an automatic garage door opener. The backup mechanism causes the lower corners of the door to be secured when in the closed position and to be unlocked by the oepration of the garage door opener when the door is to be opened.

7 Claims, 3 Drawing Sheets

GARAGE DOOR LOCKING MECHANISM

BACKGROUND

1. Field of the Invention

This invention is directed to security systems, in general, and to a garage door security system, in particular.

2. Prior Art

There are many types of garage doors which are known in the art. These include roll-up types, track types and swing-up types.

In addition, there are many types of automatic garage door openers known in the art. These garage door openers comprise chain driven door openers, belt-driven openers, shaft-driven openers and the like.

When automatic garage door openers are used in conjunction with garage doors, especially the swing-up or hinged type garage doors, a false sense of security frequently exists. That is, with the door closed and the garage door opener rendered inoperative, a substantial load or burden is applied to the door whereupon opening of the door is made relatively difficult. Therefore, many people believe that the door is completely secure. However, it has been observed by many criminals and, as a consequence, by many law enforcement agencies, that most swing-up garage doors, even with the automatic garage door opener in place, have a certain amount of play or potential movement at the bottom of the door. Thus, with the exertion of some effort, a space can be created at the bottom of the garage door of the type discussed wherein a criminal can gain access to the interior of the garage and then, in a leisurely fashion, make whatever efforts are required to gain access through an interior garage door into an attached residence or other structure.

Prior efforts have not been successful in causing or arranging for the garage door to be rendered totally secure. For example, an attempt to render tne garage door opener apparatus sufficiently rigid or stiff so as to prevent unauthorized movement of the door is virtually impossible. If this were accomplished, severe problems could be encountered in the operation of the garage door opener, per se.

Conversely, an attempt to provide locking mechanisms at the bottom of the garage door by itself, are usually quite cumbersome. That is, a separate lock or bolt arrangement necessitates a further operation in opening of the garage door. For example, if the door is locked from the outside, it can usually only be unlocked from the outside. On the other hand, if a dead-bolt is provided from the inside, actuation of the door release mechanism is only permitted from the inside. Also, it frequently occurs that the person who wishes to open the garage door is on the wrong side of the door relative to the locking mechanism.

Even in the event that a suitable locking mechanism can be arranged to be unlocked from the outside under any circumstances, many of the advantages of an automatic garage door opener are lost. The only advantage which is retained is the mechanical advantage of having the garage door lifted by the mechanism. The advantage of remaining in the car during inclement weather, as a safety precaution at night and so forth are overcome and lost.

Nevertheless, it is highly desirable to produce a means for providing security at the bottom portion of the garage door.

SUMMARY OF THE INVENTION

This invention is directed to a garage door locking mechanism which is used in conjunction with an automatic garage door opener apparatus. In particular, the mechanism includes locking means mounted or disposed at the lower or bottom corners of a garage door. These locking means are disposed to securely engage the door frame so that the bottom of the door is not readily movable when the locking mechanisms are in place.

The locking mechanisms are connected to the garage door opener apparatus through suitable cable and cable adjustment means so that the locking mechanisms are selectively disengaged from the door frame when the garage door opener is activated.

DESCRIPTION OF A PREFERRED EMBODIMENT

Figure 1:
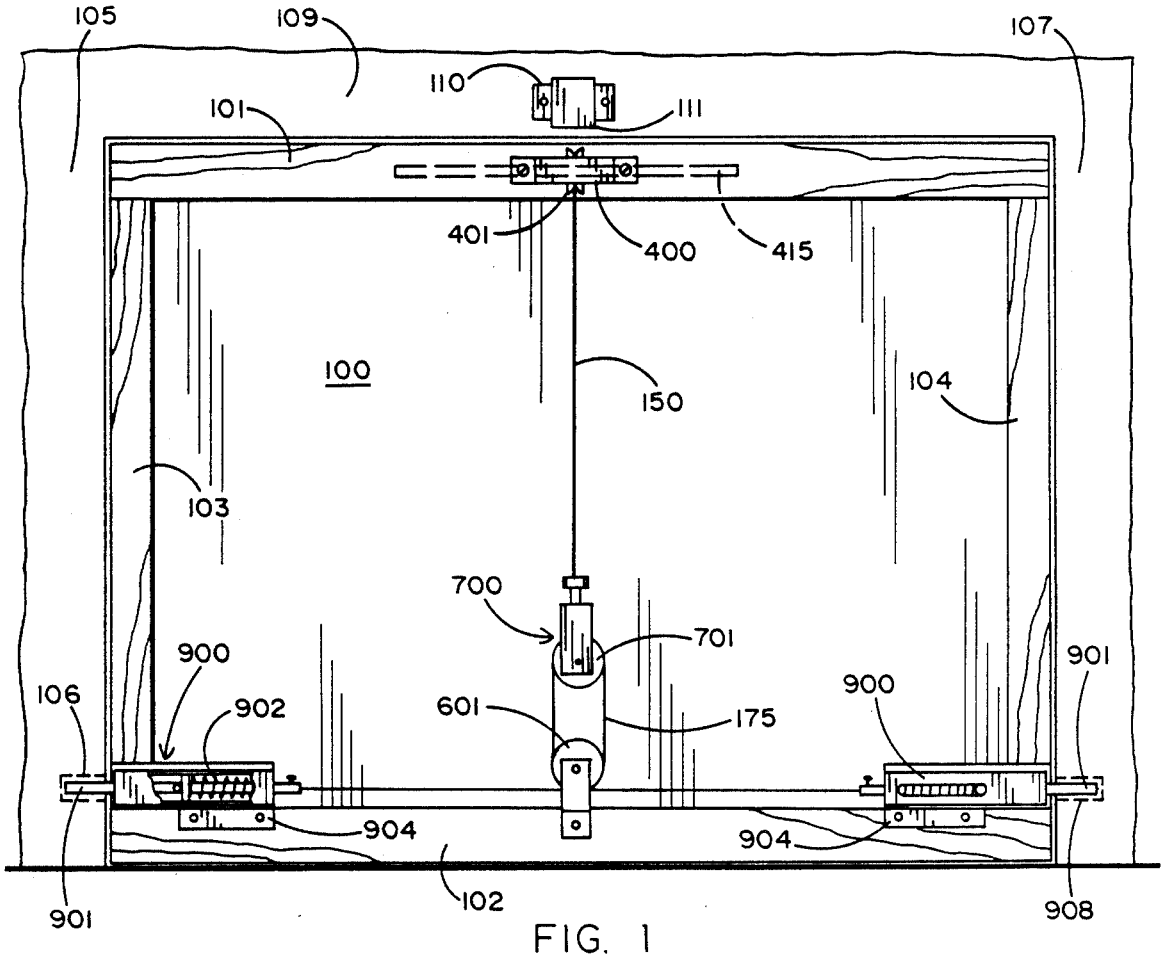
FIG. 1 is a schematic view of the door locking apparatus in relation to a garage door structure.

Referring now to FIG. 1, there is shown a schematic representation of a garage door (from tne interior of the garage) with the apparatus of the instant invention in place. The garage door 100 includes a frame fabricated of an upper cross member 101, a lower cross member 102 and side members 103 and 104 whicn comprise a frame of a standard or typical door construction. Of course, other supports, cross members, vertical members or the like can be included and utilized as desired.

The garage door 100 is arranged to fit within a frame comprising side members 105 and 107 which are formed as an integral part of the structure in which the garage door is mounted. For convenience, the springs, hinges and other paraphernalia are not shown. However, it is understood that these components are available and can be utilized. In addition, a bore or blind hole 106 is provided in side frame 105 while a similar bore or blind hole 108 is provided in side member 107.

In a typical arrangement, a garage door opener is arranged to have an end bracket 110 mounted on the upper frame member 109 (or header) of a garage opening into which door 100 is mounted. The bracket 110 is used to support one end of a track of suitable contruction and represented by track 111 (in FIG. 2) on which the garage door opener mechanism operates, as described hereinafter.

In addition, an interconnection or linkage is made between the door 100 and the track 111. This connection is not shown in FIG. 1 for convenience but is shown hereinafter. The slider linkage is connected between the track 111 and the upper frame member 101 of the door 100.

In addition, an upper guide 400 is mounted to the upper frame 101 in a suitable fashion such as by means of a screws or bolts or the like. The upper guide 400 includes a sheave or pulley 401 which is rotatably mounted in the guide 400. A cable 150 passes over or around the sheave 401 and is connected to and, effectively operated by, the garage door opener as described hereinafter. The cable 150 is connected to a cable slack adjuster 700 which is described in greater detail hereinafter. Slack adjuster 700 includes a sheave 701 and permits adjustment of cable 150 so that slack is avoided. Thus, cable 150 is maintained relatively taut (although not necessarily under tension) in a typical configuration.

Slack adjuster 700 is connected to a lower pulley assembly 600 (see FIG. 6) by means of the cable 175. Cable 175 goes around the sheave 701, in the single groove thereof, and then is arranged to go around the sheaves 601 and 603 in the lower pulley assembly. The opposite ends of cable 175 are connected to the respective lock pin assemblies 900 which are disposed and mounted at opposite sides of the garage door 100, adjacent to bottom portion 102 thereof. As will be seen, each of the lock pin assemblies includes a pin 901 which is fastened to the end of cable 175 in a suitable fashion. In addition, assembly 900 includes a spring 902 which is, typically, under compression so as to force pin 901 out of the housing of assembly 900. The pin may be arranged to extend into the appropriate bore 106 or 108 as the case may be. Alternatively, the pins 901 may merely extend beyond the side members 103 and 104 to make contact therewith only when the door 100 is moved without retracting the pins.

In the operation of the system as shown in FIG. 1, it is assumed that in the closed and locked position, the pins 901 extend out of the assembly housing 900 and engage the respective bores 106 and 108 or the surface of the side members lO6 and 105 respectively. Thus, the bottom corners of the garage door 100 are effectively locked in place and cannot be moved so as to provide a significant space between the door and the structure. The upper portion of the door is effectively locked in place by the garage door opener mechanism. The middle of the door is, typically, locked in place by the hinged spring apparatus. Thus, a secured garage door is provided.

When the garage door is to be opened, the cable 150 is pulled by the garage door opener (as described infra). When cable 150 is pulled, the slack adjuster 700 is also pulled upwardly in the embodiment shown in FIG. 1. When adjuster 700 moves upwardly, cable 175 is placed under tension and effectively pulled around the pairs of sheaves 601. Thus, the opposite end portions of cable 175 cause the separate sheaves 601 to rotate in opposite directions and pull on the respective pins 901 with sufficient force to overcome the compression force of the springs 902. Thus, the pins 901 are retracted from the respective bores 106 and 108 whereupon the bottom of the door is now free to move.

Figure 2:
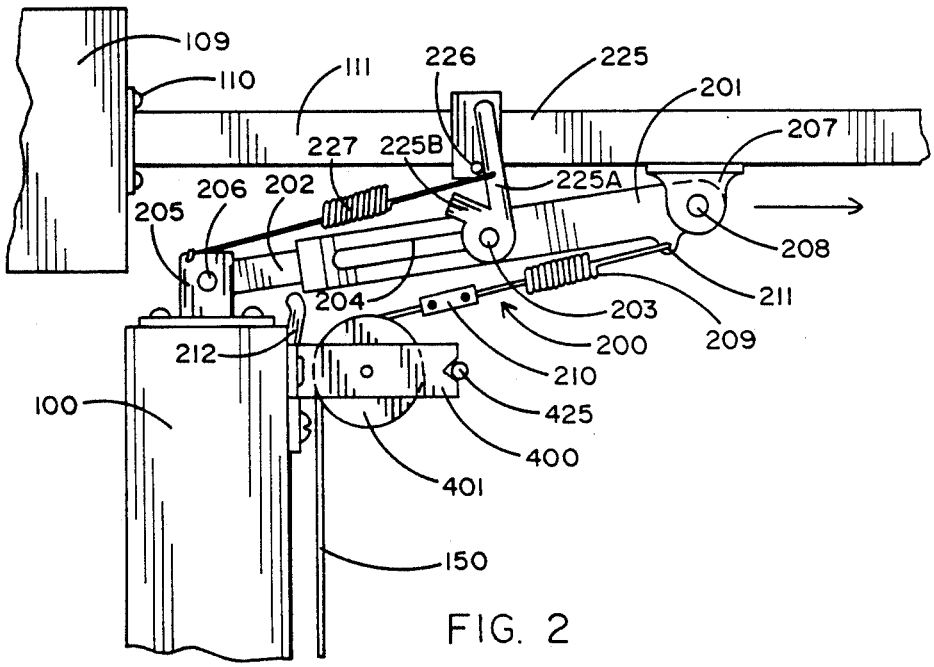
FIG. 2 is side or plan view of the slider assembly of the locking apparatus with the door closed.

Referring now to FIG. 2, there is shown a side or plan view of the garage door opening mechanism as modified to implement the instant invention. In this FIG. 2, the door 100 is shown mounted vertically. The support bar 111 for the garage door opener mechanism is shown mounted to the header 109 by a suitable bracket 110.

The garage door linkage assembly 200 is mounted between the top of door 100 and the garage door opener mechanism as represented by track support bar 111. In particular, a suitable mounting bracket or clevis 207 is mounted to move along the track bar 111 when the garage door opener is operated. Conversely, the mounting bracket or clevis 205 is mounted securely to the upper portion of door 100, typically on the upper surface of upper cross member 101 shown in FIG. 1. The linkage mechanism 200 includes interacting or nesting elements comprising an inner slider bar 202 which is, typically, mounted at a pivot pin 206 to the bracket 205. Likewise, the outer slider bar or sleeve 201 is pivotally mounted to the clevis 207 by means of a pivot pin 208. The outer slider sleeve 201 includes a slot 204 therein. The slot 204 is adapted to receive a pin 203 which is mounted adjacent to the end of inner slider bar 202. In some embodiments, the pin 203 may be adjustably located by means of suitable attachments to the slider bar 202.

Likewise, the upper guide assembly 400 is mounted to the upper portion of the door 100 as shown and described relative to FIG. 1. A cable retainer 212 is also mounted adjacent to the upper guide pulley assembly 400 and is used to assure that the cable 150 does not come off of the sheave 401. In some instances, the retainer 212 is not necessary or it may be provided in some other fashion, such as mounting it across the pulley assembly 400. A retainer bar 425 is disposed adjacent to the upper guide assembly and may represent a conventional brace which is used to maintain the rigidity and configuration of the garage door 100.

The cable 150 passes around the sheave 401 in the guide assembly 400 and is connected to a suitable mounting element 211 at or adjacent to the outer sliding sleeve 201 or any other suitable mounting arrangement adjacent to the bracket 207. In a preferred embodiment, the cable is connected to element 211 by means of a suitable tension relief spring 209. The spring 209 permits a certain amount of flexibility in the cable operation while maintaining the cable under a certain amount of tension without compromising the strength of the cable. A suitable coupler 210 is used to connect the cable to the spring.

An optional slider latch 225 can be added to the slider assembly 200 in order to prevent the possibility of the lock pins 901 from being inadvertently released when the garage door opener mechanism is pushing on the slider assembly 200 in order to close door 100. That is, the latch 225 is pivotally or rotatably mounted around pin 203. An elongated arm 225A extends outwardly from the slider assembly 200. A short arm 225B extends at an angle from the arm 225A.

A return spring 227 is connected between the elongated arm 225A and a suitable reference point such as the clevis 205. The return spring tends to cause latch 225 to rotate around pivot pin 203. However, in the situation where the door 100 is in the closed position, the latch 225 abuts against a suitable abutment, such as pin 226, which is mounted in a fixed position on the bar 111. In this configuration the latch 225 does not affect the operation of the slider assembly 200.

Figure 3:
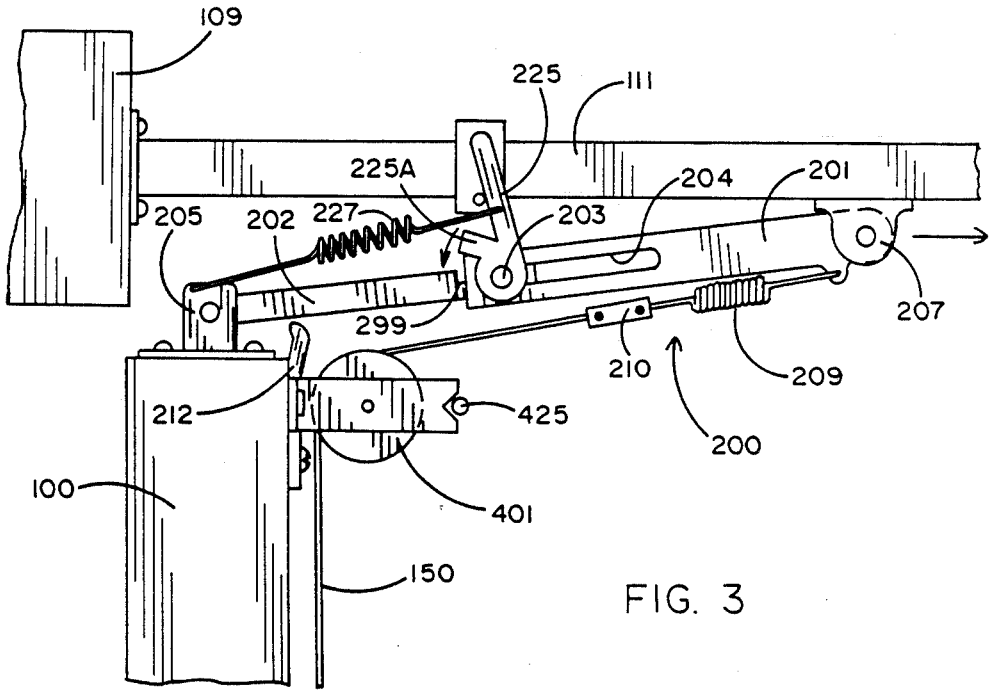
FIG. 3 is a side or plan view of the slider assembly of the locking mechanism with the lock pins released and the door ready to open.

Referring now to FIG. 3, there is shown another side or plan view of the slider/linkage mechanism shown in FIG. 2 at a different status in the operation of the invention. In this Figure, similar components bear similar reference numerals.

In the embodiment shown in FIG. 3, the situation exists wherein the lock pins 900 (see FIG. 1) have been released but the garage door 100 has not yet begun to be moved or opened as a result of the activity of the garage door operator mechanism.

In FIG. 3, the bracket or clevis 207 has moved to the right in response to the activation of the garage door opener mechanism. As a result of the movement and relocation of clevis 207, cable 150 has been moved, as well. In particular, cable 150 has been pulled upwardly (on the vertical run) and to the right (on the horizontal run) after it has passed around sheave 401.

Moreover, outer sleeve 201 has moved along with the bracket 207 while inner sleeve 202 has remained essentially stationary along with bracket 205. However, it is clear that the pin 203 has now moved relative to slot 204 (or vice versa). In the embodiment shown, the pin 203 has moved from one extreme end to the other extreme end of the slot 204. However, the slide linkages 201 and 202 have moved freely, relative to each other, with no impact on the door 100, per se. It is clear that as bracket 207 continues to move further to the right, the end or edge of slot 204 will engage pin 203 whereupon movement of sleeve 201 (as a result of movement of bracket 207) will now interact with and move sleeve 202. This will, of course, be translated into a movement of bracket 205 and door 100.

Likewise, when the outer sleeve 201 moves toward the right, the groove or notch 299 in the inner sleeve 202 is exposed. In response to the force supplied by return spring 227, the latch 225 tends to rotate around pivot pin 203 so that tne arm 225B moves into slot 299. Of course, this rotation is controlled, in part, by pin 226 which is, as noted, fixed relative to bar 111. However, as the slider mechanism 200 continues to move toward the right (in accordance with the showing of FIG. 3), the fully extended slider apparatus also begins to move, in toto, to the right wherein latch 225 is moved relative to locking pin 226 in response to the action of spring 227.

The critical factor that must be understood is that as of the operation shown in FIG. 2 lock pins 901 (see FIG. 1) are engaged. However, in the condition shown in FIG. 3, it should be recognized that the lock pins have been disengaged but the door 100 has not yet been moved. Consequently, there is no engagement applied between the locking apparatus 900 and the door frame.

Figure 4:
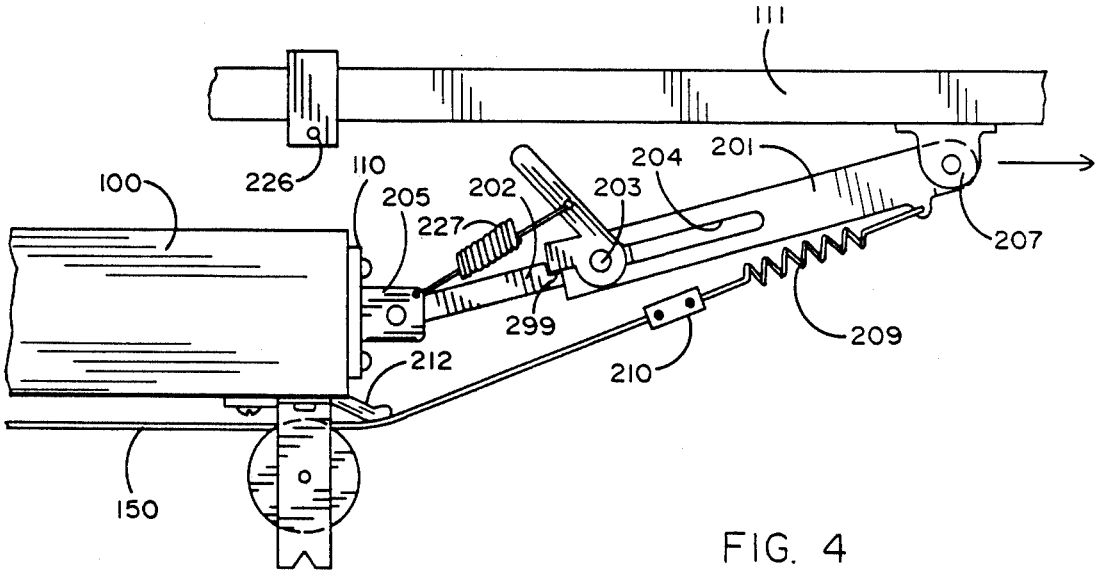
FIG. 4 is a side or plan view of the slider assembly of the locking mechanism with the door open and the lock pins released.

Referring now to FIG. 4, there is shown another side or plan view of the linkage apparatus shown in FIGS. 2 and 3. Again, in FIG. 4, the same reference numerals refer to similar components.

More particularly, in this embodiment bracket 207 has now been moved to the ultimate open position by the garage door opener including bar 111. That is, as is shown, the garage door 100 is now in the open or horizontal condition. This has been affected by movement of bracket 207 which has caused tne linkage mechanism comprising bars 202 and 201 to move in the engaged position (i.e. pin 203 is engaged with slot 204) whereupon bracket 205 is moved together with door 100. In this instance, it is seen that the cable 150 is maintained in contact with the sheave 401 by the retainer 212.

Also, as seen in this embodiment the tension spring 209 has been extended. In this instance, it is presumed that the cable 150 is maintained under tension so that the pins 901 in the locking apparatus 900 do not move out of the pin housing. Moreover, the cable can be maintained under a controlled tension while permitting a certain amount of tolerance in the length of cable required in tne apparatus. As shown in FIG. 4, the slider mechanism is fully extended and the latch mechanism 225 has moved out of engagement with pin 226. Consequently, the spring 227 has pulled latch 225 pivotally around pivot pin 203 so that the latch arm 225B is now in full engagement with the lip of notch 299.

In the operation of opening the door, this status of the latch has little or no effect. However, in the operation of closing the door, the latch 225 remains in the position shown in FIG. 4 at the initiation of the closing operation. Consequently, the extended latching or slider assembly comprising inner sleeve 202 and outer sleeve 201 do not move with respect to each other. Consequently, the closing force which is supplied by the slider assembly mechanism to the top of the door 100 is maintained constant and the slider assembly mechanism does not begin to telescope. Thus, cable 150 and pins 901 do not move relative to the garage door 100.

However, as the door closing operation continues, the arm 225A of latch 225 again moves into engagement with pin 226, as shown in FIGS. 2 or 3, thereby causing the latch 225 to rotate around the pivot pin 203 (against the force of return spring 227). When the door closing operation has progressed sufficiently, latch 225 has rotated such that the arm 225B is removed from engagement with the notch 299 and the slider mechanism continues to telescope to the extent shown in FIG. 2.

Figure 5:
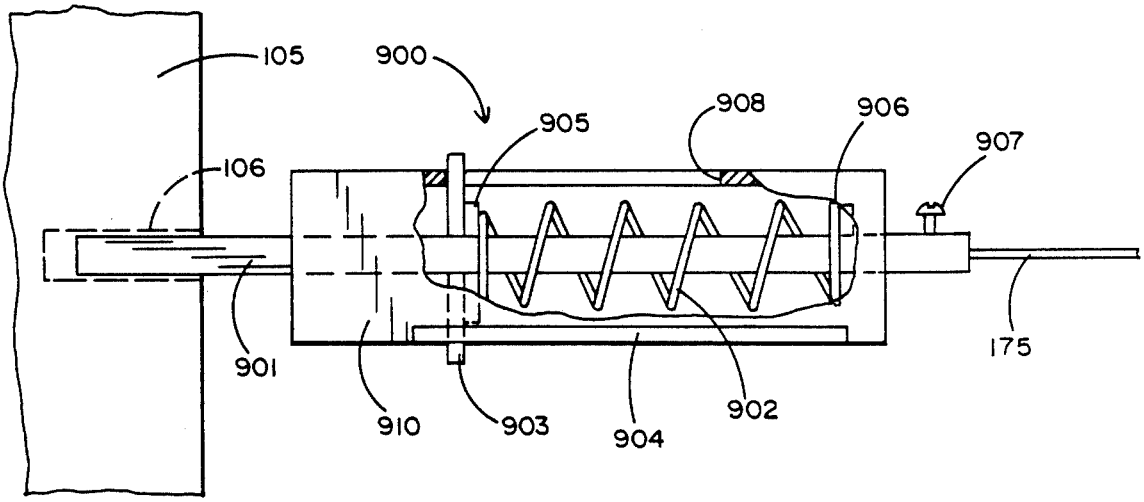
FIG. 5 is a partially broken away, view of the lock pin assembly of the instant invention.

Referring now to FIG. 5, there is shown a partially broken away view of the lock pin assembly 900 shown in FIG. 1. In particular, the lock pin assembly 900 includes a tubular housing 910 which can be rectangular, cylindrical, or the like depending upon various design considerations, including cost effectiveness. A flange 904 is arranged to extend outwardly from the bottom side of housing 910 for mounting the assembly 900 to the garage door. The flange 904 can extend from one or both sides of the housing 910. Alternatively, the flange can be mounted at the side of the housing 910, if so desired.

A lock pin 901 is mounted in housing 910 along the longer axis thereof. In particular, the end caps of housing 910 are arranged to include apertures (not shown) therein through which the lock pin 910 is free to pass.

The housing 910 includes a pair of oppositely disposed slots 908 at the top and bottom of the housing 910. These slots 908 extend for a prescribed portion of the length of housing 910. Of course, in some embodiments, only a single slot 908 is provided.

A guide pin 903 is disposed through and mounted with lock pin 901. The guide pin 903 extends through the slots 908 and is constrained in its movement by the slots. Thus, neither the guide pin 903 nor the lock rotate about the axis of the housing and can move lengthwise for only a portion of the housing as defined by slots 908.

Suitable spring retainer devices 905 and 906 are disposed at appropriate locations within the housing. In particular, retainer 905 is disposed adjacent to the guide pin 903 while retainer 906 is disposed adjacent the end portion of housing 910. The retainers 905 and 906 are adapted to retain spring 902 in position surrounding lock pin 901.

The end of cable 175 is coupled to pin 901 in a suitable fashion. In the illustration, cable 175 is inserted into a bore in the end of pin 901 and retained therein by a suitable cable retainer screw 907.

In operation, the assembly 900 is mounted to the door 100 by means of flange 904 as well as screws, bolts or the like. The assembly 900 is arranged so that the pin 901 extends therefrom a sufficient distance to engage the side member 103 (or the bores or slots 106 and 108 if utilized) as shown in FIG. 1 when the door 100 is in the closed position and the garage door opener mechanism has not begun to activate.

On the other hand, the assembly 900 must be positioned so that when the cable 175 is pulled by the garage door opener apparatus as shown in FIGS. 2, 3 and 4, the pins 901 are moved a sufficient distance to disengage from the garage door frame.

In this instance, cable 175 which is fastened to pin 901 by means of retainer screw 907, effectively, pulls pin 901 to the right (as shown) against the force exerted by compression spring 902. The spring abuts against the retainer 906 (or the end of the housing 910) and the retainer 905 which is positioned adjacent to tne pin 903. In some instances, the pin 903 may be sufficient to provide this function. Otherwise, retainer 905 may be in the form of a washer or the like.

When the door is to be closed, the opposite operation occurs. That is, cable 175 is released which permits the spring 902 to force the pin 901 to the left (in this embodiment) until pin 903 abuts the inner end of the slots 908 whereupon pin 901 effectively engages the garage door frame and secures the garage door.

Of course, the arrangement of the lock pin assembly can be altered so that the lock pin 903 as mounted in grooves internally of the apparatus rather than through slots in the exterior. Other arrangements can be made as well as noted above.

Figure 6:
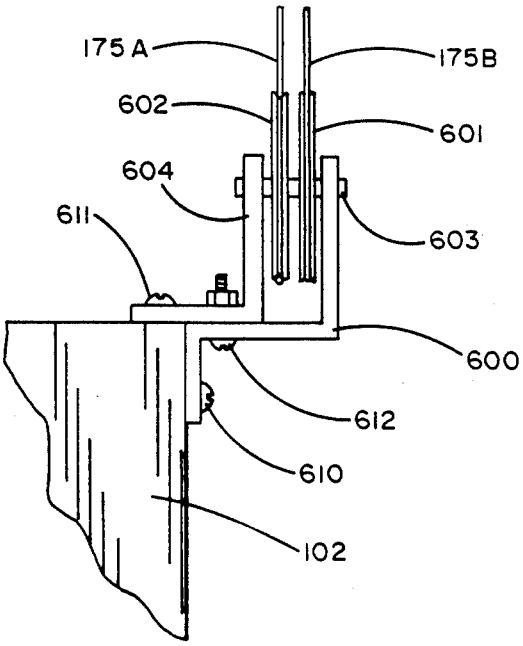
FIG. 6 is a side view of the lower pulley assembly of the instant invention.

Referring now to FIG. 6, tnere is shown the lower pulley assembly shown in FIG. 1. In this assembly, a first mounting bracket 600 is provided which is arranged to be affixed to the door frame 102 by any suitable means such as screws 610 or the like. A mating or co-acting bracket 604 is also arranged to be mounted to tne door 102 by screws 611 or the like. Alternatively, bracket 604 can be affixed to bracket 600 by means of additional screws 613, rivets or the like. An axle or axial pin 603 extends between the two upright portions of the brackets 600 and 604. A pair of sheaves or rollers 601 and 602 are mounted on the axle 603 so as to be spaced apart from each of the brackets 600, 604 and from each other. The rollers 601 and 602 are individually operable so that they can operate independent of each other and rotate in opposite directions, as may be the case. In reference to FIG. 1, it is seen that the brackets 600 and 604 are mounted on the door frame 102. The cable 175 is arranged to have one portion thereof pass around guide roller 601 and tne other portion of the cable passes around guide roller 602. In the embodiment shown, in FIG. 6, the cable portion 175 passes around the near side of the roller and goes away from the plane of the drawing while the cable portion 125 goes around the far side of guide roller 602 and moves outwardly from the plane of the drawing. Thus, when cable 175 is moved, as a unit, the opposite ends thereof move in opposite directions.

Obviously, the brackets 600 and 604 can be fabricated as a single unit with the axle and rollers mounted therein. However, for kit form or the like, it is proposed that the bracket arrangement shown in FIG. 6 be utilized.

Figure 7:
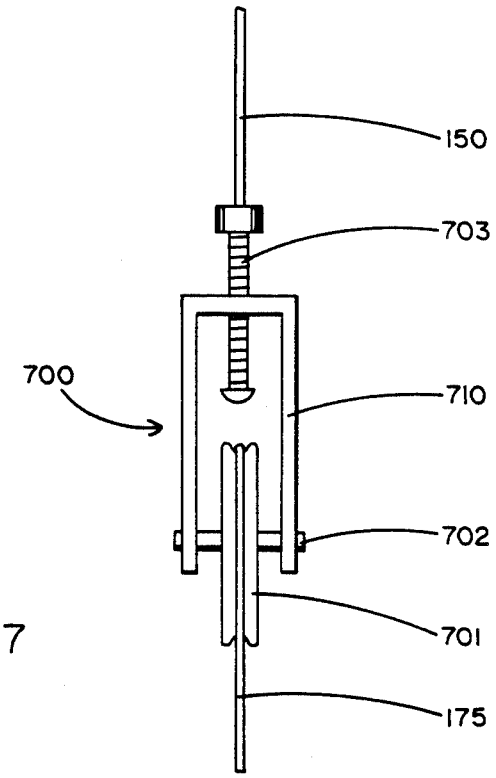
FIG. 7 is a side view of the equalizer assembly of the instant invention.

Referring now to FIG. 7, there is shown a side or plan view of the equalizer assembly 700 as seen in FIG. 1. In this Figure, the equalizer assembly 700 is shown to include a bracket or clevis 710 which includes an axle or pivot 702 at the opposed ends of the unit. A suitable guide roller 701 is mounted on the axle 702 and the cable 175 passes around the roller or sheave 701. In addition, an adjustable threaded member 703 is threadedly engaged with the base of the clevis 710. The threaded screw member 703 is, therefore, adjustable relative to the bracket 710. The cable 150 which is attached to the garage door opener is mounted at the end of the screw 703 by any suitable fashion such as a knurled nut or the like.

In operation, the equalizer is assembled in the apparatus of the invention by placing cable 175 around the sheave 701. The cable 150 is then attached to the screw adjustment 703. Presuming that the various cables have been reasonably and appropriately trimmed and the like for a reasonable fit, a minor adjustment is permitted by adjusting threaded screw 703. Moreover, as the cables 150 and/or 175 tend to stretch over time, minor adjustments can continue to be made by adjustment of threaded screw 703. Of course, if the stretching or expansion of the cables (or other components) becomes excessive, the respective cables can be trimmed or shortened as may be required.

Figure 8:
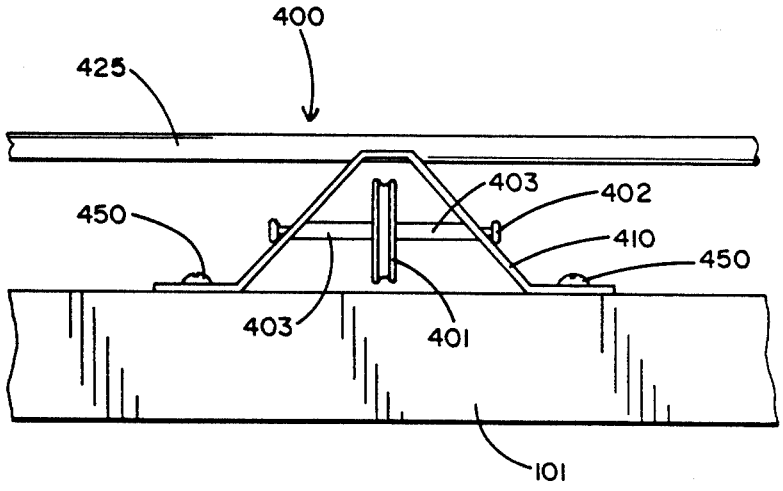
FIG. 8 is a side view of the upper guide roller of the apparatus of the instant invention.

Referring now to FIG. 8, there is shown a detailed, side view of the upper guide roller assembly 400 shown in FIG. 1. In this case, the support bracket 410 is substantially triangular in shape and is mounted to the inside of upper door frame 101 by means of suitable screws 450, bolts or the like. A guide roller or sheave 401 is mounted within the bracket 410. The sheave is mounted on a pivot pin or axle 402 which passes through the respective sides of the angulated bracket 410. Suitable spacer bushings 403 are used to maintain the sheave 401 in the center of the bracket.

While an angulated bracket 410 is shown, it is understood that this design is not limitative of the invention. Rather, otner bracket shapes can be considered as well.

In the embodiment shown, the brace rod 425 is shown mounted at the upper or free end of bracket 410. The brace rod 425 is shown, in dashed outline, in FIG. 1 and is a typical brace rod which extends across the width of the garage door to inpart a certain amount of additional rigidity or the like. The brace rod is not essential to the operation of the invention as shown and described herein. In fact, with many cases, the brace 425 is not utilized in the garage door. However, the apparatus, as shown in FIG. 8, describes an assembly wherein the door brace rod 425 can be utilized in conjunction with the apparatus of this invention.

In summary, the invention comprises an apparatus which is used with a garage door in conjunction with a garage door opener. Locking pins are arranged to lock the bottom portion of the garage door to the garage door frame. The apparatus includes cable driven mechanisms which permit ready assembly of the apparatus to a garage door as an after-market accessory.

The existing garage door opener is connected to the latching mechanism in such a fashion that the locking pins at the bottom of the door are disengaged by the operation of the garage door opener before the garage door opener engages the actual garage door opening mechanism.

Conversely, after the garage door has been fully closed, the latching mechanism is operable to secure the garage door to the frame.

Thus, there is shown and described a new and unique garage door security apparatus. This apparatus can be used with existing garage door opening equipment.

While a preferred embodiment is shown and described, it is clear that those skilled in the art may conceive modifications and changes to the invention. For example, separate coupling means can be used with the cables. The cables can be, in some cases, replaced by mechanical linkages or the like. However, any such modifications or changes which fall within the purview of this description are intended to be included therein as well. It is to be understood that this description is intended to be illustrative of the invention only and is not intended to be limitative. Rather, the scope of the invention is limited only by the claims appended hereto.

I claim:

1. In combination with a garage door and an automatic garage door opener, linkage means adapted for connecting said garage door to said garage door opener whereby said garage door is selectively moved by said garage door opener, said linkage means includes a pair of telescoping elements at least one of which is pivotally mounted to the top of said garage door, locking assembly means mounted adjacent to the sides of the inside bottom portion of said garage door, said locking assembly means includes a slidable locking pin for selectively locking said garage door, cable means connected between said linkage means and said locking assembly means in order to selectively apply force to said slidable locking pin of said locking assembly means thereby to unlock said garage door, said cable means comprising first and second elongated cable elements, first sheave means rotatably mounted adjacent the top edge of said garage door for passing said first elongated cable element thereover, cable slack adjustment means connected to said first elongated cable element in order to adjust the length thereof to eliminate slack in said first elongated cable element, second sheave means rotatably mounted adjacent the bottom edge of said garage door for passing said second elongated cable element therethrough to said locking assembly means, said second sheave means includes a plurality of sheaves on a common axle and capable of rotation in opposite directions, said second elongataed cable element having the opposite ends thereof connected to said locking assembly means, cable retainer means mounted adjacent to said first sheave means to retain said first elongated cable element on said first sheave means, latch means incorporated into said pair of telescoping elements to selectively prevent the telescoping elements from telescoping on each other to reduce the overall length thereof, said latch means includes a return spring for positioning said latch means, one of said pair of telescoping elements includes a notch for receiving said latch means, said latch means is pivotally mounted on the other one of said pair of telescoping elements.

2. The combination recited in claim 1 wherein, said slack adjustment means includes third sheave means adapted to receive said second cable means therearound and said first cable means attached thereto.

3. The combination recited in claim 1 wherein, said lock pins are secured to said second cable by retainer screws.

4. The combination recited in claim 1 wherein, said telescoping elements slide relative to each other.

5. The combination recited in claim 1 wherein, said lock pins are spring loaded outwardly from said housing into the locking position.

6. The combination recited in claim 1 wherein, said lock pin assembly means includes housing mounted at the bottom edge of the garage door to support said slidable lock pins therein.

7. The combination recited in claim 6 wherein, said housing has a rectilinear tubular configuration.

* * * * *